US009585507B2

(12) United States Patent
Lueth et al.

(10) Patent No.: US 9,585,507 B2
(45) Date of Patent: Mar. 7, 2017

(54) MANUAL TRANSPORTATION OF ARTICLES

(71) Applicants: Jacquelynn R. Lueth, Encino, CA (US); William D. Garnet, Encino, CA (US)

(72) Inventors: Jacquelynn R. Lueth, Encino, CA (US); William D. Garnet, Encino, CA (US)

( * ) Notice: Subject to any disclaimer, the term of this patent is extended or adjusted under 35 U.S.C. 154(b) by 0 days.

(21) Appl. No.: 14/223,641

(22) Filed: Mar. 24, 2014

(65) Prior Publication Data

US 2014/0203052 A1 Jul. 24, 2014

Related U.S. Application Data

(60) Continuation-in-part of application No. 11/368,873, filed on Mar. 6, 2006, now abandoned, and a division (Continued)

(51) Int. Cl.

| | |
|---|---|
| ***A41D 27/22*** | (2006.01) |
| ***A47G 25/20*** | (2006.01) |
| ***A47G 25/44*** | (2006.01) |
| ***A47G 25/48*** | (2006.01) |
| ***A47G 25/26*** | (2006.01) |
| ***A47G 25/32*** | (2006.01) |
| ***A47G 25/40*** | (2006.01) |

(Continued)

(52) U.S. Cl.

CPC ..... *A47G 25/20* (2013.01); *A47G 25/1457* (2013.01); *A47G 25/26* (2013.01); *A47G 25/32* (2013.01); *A47G 25/403* (2013.01); *A47G 25/4007* (2013.01); *A47G 25/445* (2013.01); *A47G 25/485* (2013.01); *A47G 25/628* (2013.01)

(58) Field of Classification Search

CPC .... A47G 25/4007; A47G 25/20; D06F 73/00; D06F 59/02

USPC ..... 223/67, 85, 88, 92, 95, 98

See application file for complete search history.

(56) References Cited

U.S. PATENT DOCUMENTS

| | | |
|---|---|---|
| 1,368,843 A | 2/1921 | Rosenthal |
| 1,911,208 A | 5/1933 | Roman et al. |

(Continued)

FOREIGN PATENT DOCUMENTS

EP 2058429 A1 * 5/2009 ..... D06F 93/00

*Primary Examiner* — Nathan Durham

(74) *Attorney, Agent, or Firm* — Kirby B. Drake; Klemchuk LLP

(57) ABSTRACT

A garment transportation and storage device comprises a support rod at the bottom, a hook at the top, and a ball-shaped handle between the support rod and the hook for transporting garments supported on the support rod by hangers and for engaging the hook with a support structure. An article transportation and storage device comprises an inverted U-shaped frame, a support rod slidably engageable with the frame, and a hook mounted on the frame for pivotal movement between extended and retracted positions. A garment receiving and supporting hanger is provided with an inflatable garment protection device that prevents wrinkling of garments supported by the hanger. A garment transportation and support device comprises opposed garment engaging arms that pivot outwardly to securely support a garment.

1 Claim, 17 Drawing Sheets

Related U.S. Application Data of application No. 12/136,382, filed on Jun. 10, 2008, now abandoned, and a continuation of application No. 13/280,245, filed on Oct. 24, 2011, now abandoned.

(60) Provisional application No. 60/659,248, filed on Mar. 7, 2005.

(51) Int. Cl.
*A47G 25/62* (2006.01)
*A47G 25/14* (2006.01)

(56) References Cited

U.S. PATENT DOCUMENTS

| | | | |
|---|---|---|---|
| 2,023,443 | A | 12/1935 | Rogers |
| 2,499,188 | A | 2/1950 | Freedman |
| 2,622,774 | A | 12/1952 | Freeman |
| 2,781,895 | A | 2/1957 | Smith |
| 2,790,585 | A | 4/1957 | Smith |
| 2,813,667 | A | 11/1957 | Gross |
| 2,875,931 | A | 3/1959 | Monteleone et al. |
| 2,946,493 | A | 7/1960 | Bury et al. |
| 2,977,001 | A | 3/1961 | Vitale |
| 3,298,578 | A | 1/1967 | Shields |
| 3,531,027 | A | 9/1970 | Malmin |
| 3,584,772 | A | 6/1971 | Robertson |
| 3,602,408 | A | 8/1971 | Gaydos |
| 3,692,218 | A | 9/1972 | Friedman |
| 3,731,809 | A | 5/1973 | Saenger |
| 3,779,434 | A | 12/1973 | Malmin |
| 3,885,723 | A | 5/1975 | Magnie |
| 3,923,212 | A | 12/1975 | Brunner |
| 4,045,067 | A | 8/1977 | Wieder et al. |
| 4,091,976 | A | 5/1978 | Morse |
| 4,153,189 | A | 5/1979 | Hughes |
| 4,284,219 | A | 8/1981 | Standel, Jr. |
| 4,466,652 | A | 8/1984 | Townsend |
| 4,474,316 | A | 10/1984 | Philibert |
| 4,557,516 | A | 12/1985 | Usner |
| 4,730,863 | A | 3/1988 | Guadnola |
| 4,824,156 | A | 4/1989 | Greene |
| D307,360 | S | 4/1990 | McAllister |
| 5,263,755 | A | 11/1993 | Thompson |
| 5,328,068 | A | 7/1994 | Shannon |
| 5,398,984 | A | 3/1995 | Elder |
| 5,503,311 | A | 4/1996 | Chen |
| 5,577,644 | A | 11/1996 | Chen |
| D378,167 | S | 2/1997 | Jones, Jr. |
| 5,620,127 | A | 4/1997 | MacKenzie |
| 5,649,652 | A | 7/1997 | Sackett et al. |
| 5,894,968 | A | 4/1999 | Christensen |
| 5,899,514 | A | 5/1999 | York et al. |
| 5,938,088 | A | 8/1999 | Lam |
| 6,000,587 | A | 12/1999 | Sackett et al. |
| 6,193,290 | B1 | 2/2001 | Barbara, Jr. |
| 6,758,351 | B1 | 7/2004 | Klingsdal |

* cited by examiner

MANUAL TRANSPORTATION OF ARTICLES

CROSS REFERENCE TO RELATED APPLICATIONS

This application is a continuation of co-pending U.S. patent application Ser. No. 13/280,245 for "Manual Transportation of Articles" filed Oct. 24, 2011, which is hereby incorporated by reference, which is a divisional of U.S. patent application Ser. No. 12/136,382 for "Manual Transportation of Articles" filed Jun. 10, 2008, which is hereby incorporated by reference, which is a continuation-in-part of U.S. patent application Ser. No. 11/368,873 filed Mar. 6, 2008, which claims priority based on U.S. Provisional Patent Application Ser. No. 60/659,248, filed Mar. 7, 2005, wherein each of these applications is incorporated by reference herein in its entirety.

FIELD OF THE DISCLOSURE

The present disclosure generally relates to systems for manual transportation of articles.

BACKGROUND

When pants are cleaned by a laundry or dry cleaning service, they are traditionally returned hung over a clothes hanger having a cardboard garment support tube. If the pants, shorts, skirts, scarves, and linens are left on the clothes hanger for an extended period of time, a crease is formed at the point where the pants engage the garment support tube. Further, the cardboard support tube traditionally has a light adhesive coating that retains the pants on the hanger. The coating, however, can adversely affect delicate fabrics and eventually damage the article and degrade the appearance thereof. Clothing is also returned by a laundry or dry cleaning service supported on a plurality of hangers. Often times, the plurality of hangers is awkward to handle at best and impossible to support from the small coat hooks typically found in automobiles.

SUMMARY

Embodiments of the present disclosure generally may provide for use in conjunction with a conventional clothes hanger of the type comprising a nominally horizontally disposed garment support rod, a pneumatically activated flexible member supported on the support rod of the hanger and extending downwardly therefrom for expanding garments supported by the hanger and thereby preventing wrinkling of the garments.

Other embodiments of the present disclosure may provide an article transportation and storage device comprising a pair of substantially horizontally disposed opposed arms having pivotally connected proximal ends extending in opposite directions, each of the opposed having garment engaging teeth at the distal end thereof, a normally vertically disposed hook positioned above and substantially aligned with the pivotal connection between the opposed arms, and a lever system connected between the hook and the opposed arms for pivoting the arms upwardly and outwardly responsive to the application of weight thereto.

DETAILED DESCRIPTION

Figure 1:
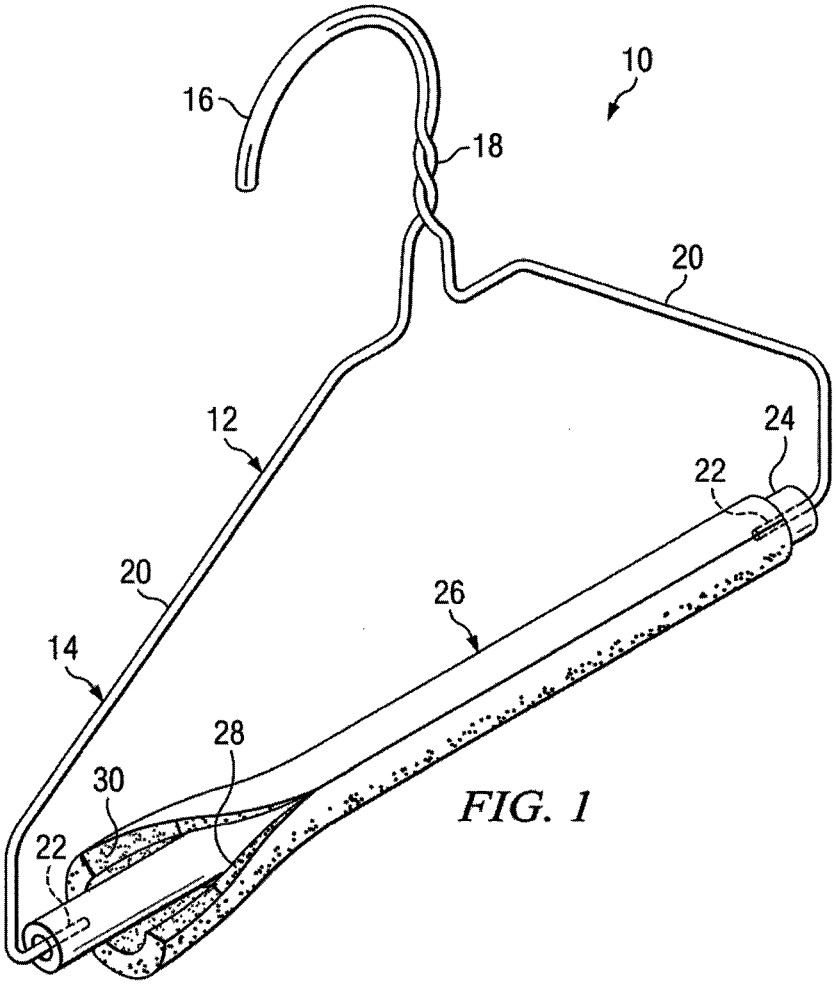
FIG. 1 is a perspective view illustrating a clothes hanger comprising a first embodiment of the present disclosure.

Referring now to the Drawings, and particularly to FIG. 1 thereof, there is shown clothes hanger 10 comprising a first embodiment of the present disclosure. Clothes hanger 10 comprises conventional clothes hanger 12 including a length of wire 14 comprising upper hook portion 16 extending to twisted portion 18 which in turn extends to a pair of downwardly and outwardly extending arms 20 terminating in support members 22. Cardboard garment support tube 24 extends between support members 22 and is supported thereby.

As is well known, utilization of hanger 10 and similar clothes hangers in the transportation and storage of garments incorporates inherent difficulties. First, cardboard garment support tube 24 defines a relatively small diameter garment support surface which tends to form creases in garments supported thereon for even a short period of time. Second, cardboard support tube 24 is frequently provided with a light adhesive coating which can damage delicate fabrics and can also damage more durable fabrics if supported on clothes hanger 10 over an extended period of time.

In accordance with a first embodiment of the present disclosure, soft sponge rubber tube 26 is received on and supported by cardboard tube 24. Soft sponge rubber tube 26 substantially increases the effective diameter of the garment support surface of hanger 10 thereby substantially decreasing the probability that garments supported thereon will be creased. Additionally, soft sponge rubber tube 26 does not require a light adhesive coating as does cardboard tube 24, thereby eliminating the possibility of damage to garments supported on hanger 10 due to contact thereof with the light adhesive coating which is typically provided on the exterior surface on cardboard tube 24.

For example, the cardboard garment support tube of a typical clothes hanger has an outside diameter of about ½ inch. The soft sponge rubber tube of the present disclosure has an outside diameter of about 1.25 inches. Thus, the effective diameter of the garment support surface of the hanger of the present disclosure is 2½ times as large as the effective diameter of the garment support surface of a conventional clothes hanger.

Soft sponge rubber tube 26 is provided with radial slit 28 that extends the entire length of tube 26 thereby facilitating deployment of tube 26 over cardboard tube 24. The opposite ends of slit 28 comprising tube 26 may be provided with lengths of double-sided adhesive tape 30 whereby the ends of slit 28 are secured against opening during utilization of hanger 10.

Figure 2:
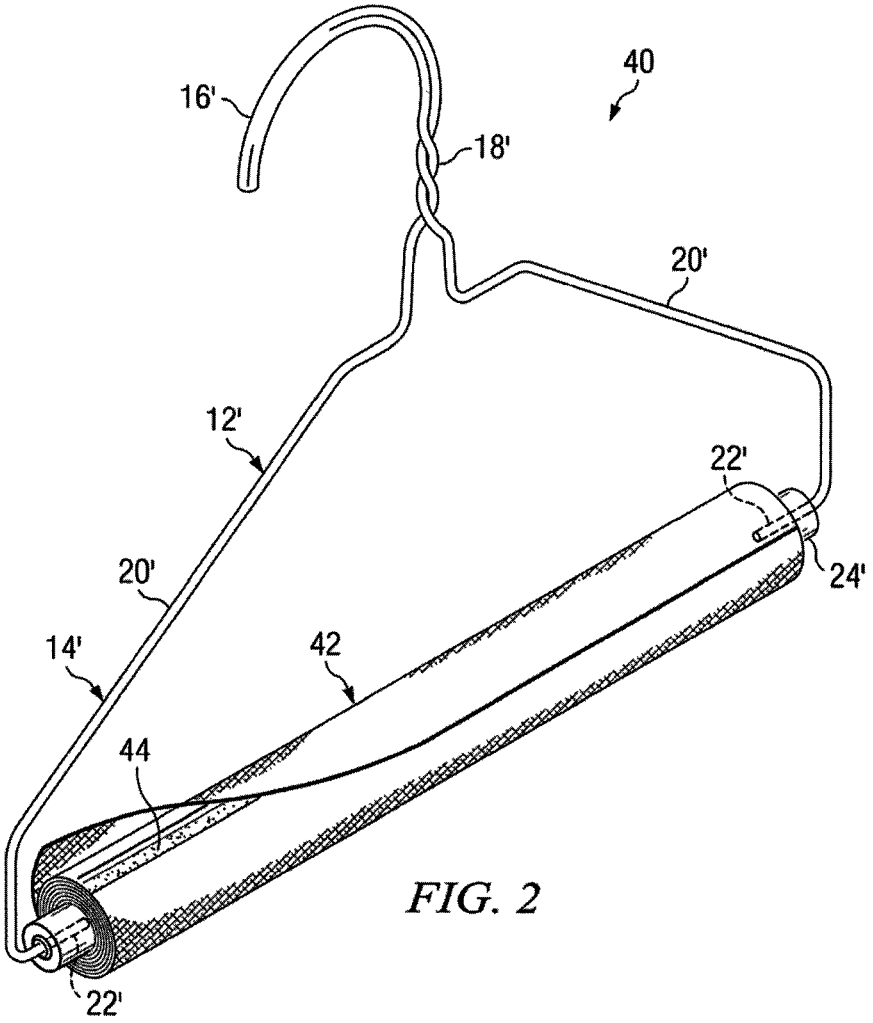
FIG. 2 is a perspective view of a clothes hanger comprising a variation of the embodiment of FIG. 1.

Referring to FIG. 2, there is shown clothes hanger 40 comprising a variation of clothes hanger 10 illustrated in FIG. 1. Many of the component parts of clothes hanger 40 are substantially identical in construction and function to component parts of hanger 10. Such identical components parts are designated on FIG. 2 with the same reference numerals utilized above in the description of clothes hanger 10 but are differentiated therefrom by means of a prime (') designation.

Clothes hanger 40 differs from clothes hanger 10 in that, rather than being provided with a soft sponge rubber tube surrounding cardboard tube 24', clothes hanger 40 is provided with tube 42 comprising a roll of fabric secured in place by adhesive layer 44. The function of tube 42 is to substantially increase the effective diameter of the clothing support surface of hanger 40. In this manner, the likelihood that garments supported by clothes hanger 40 will be creased during utilization thereof is substantially reduced. Additionally, tube 42 does not require use of a light adhesive coating as is frequently required in the use of cardboard tube 24, thereby further diminishing the possibility of damage to garments supported by clothes hanger 40.

Figure 3:
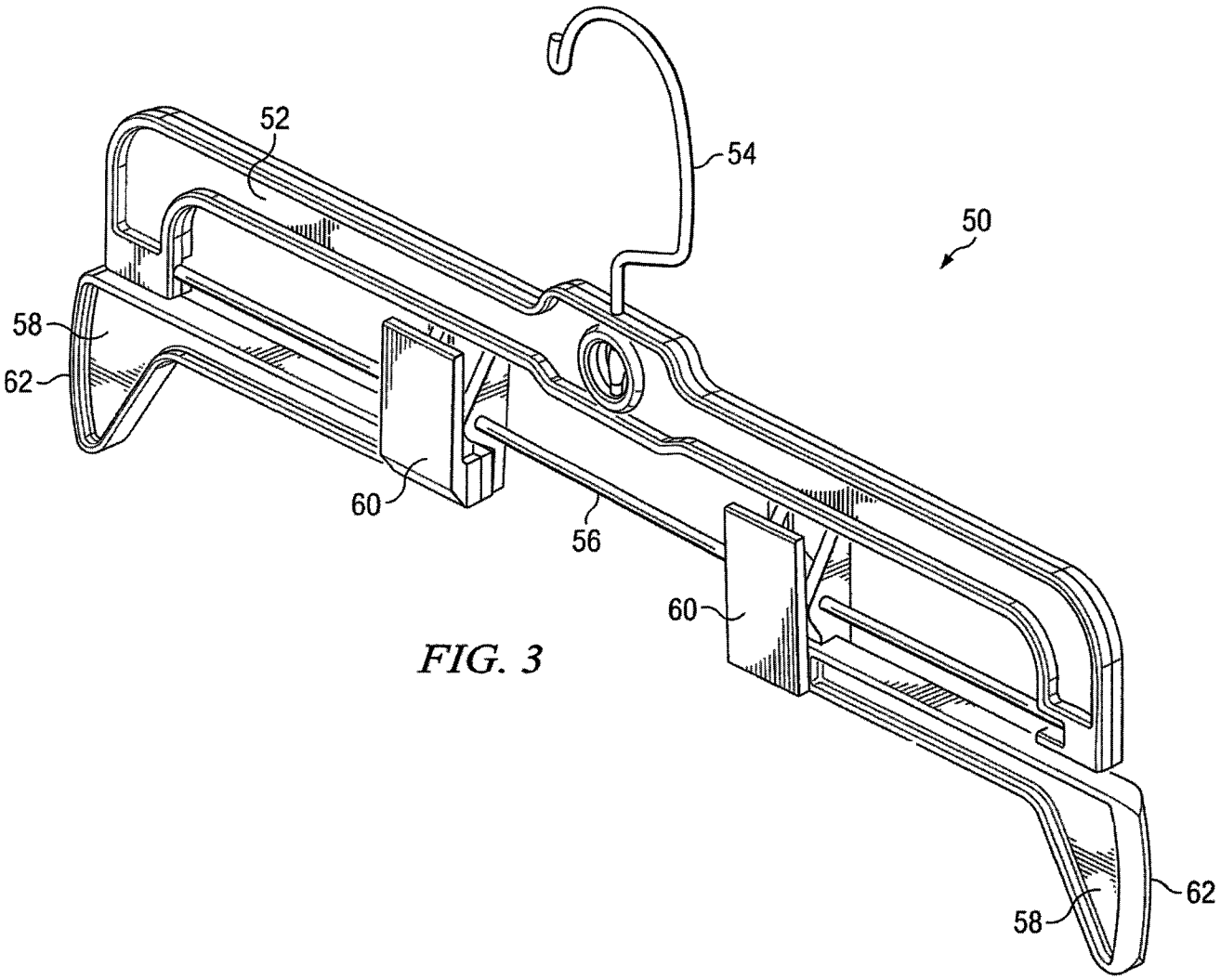
FIG. 3 is a perspective view of a clothes hanger comprising a second embodiment of the present disclosure.
Figure 4:
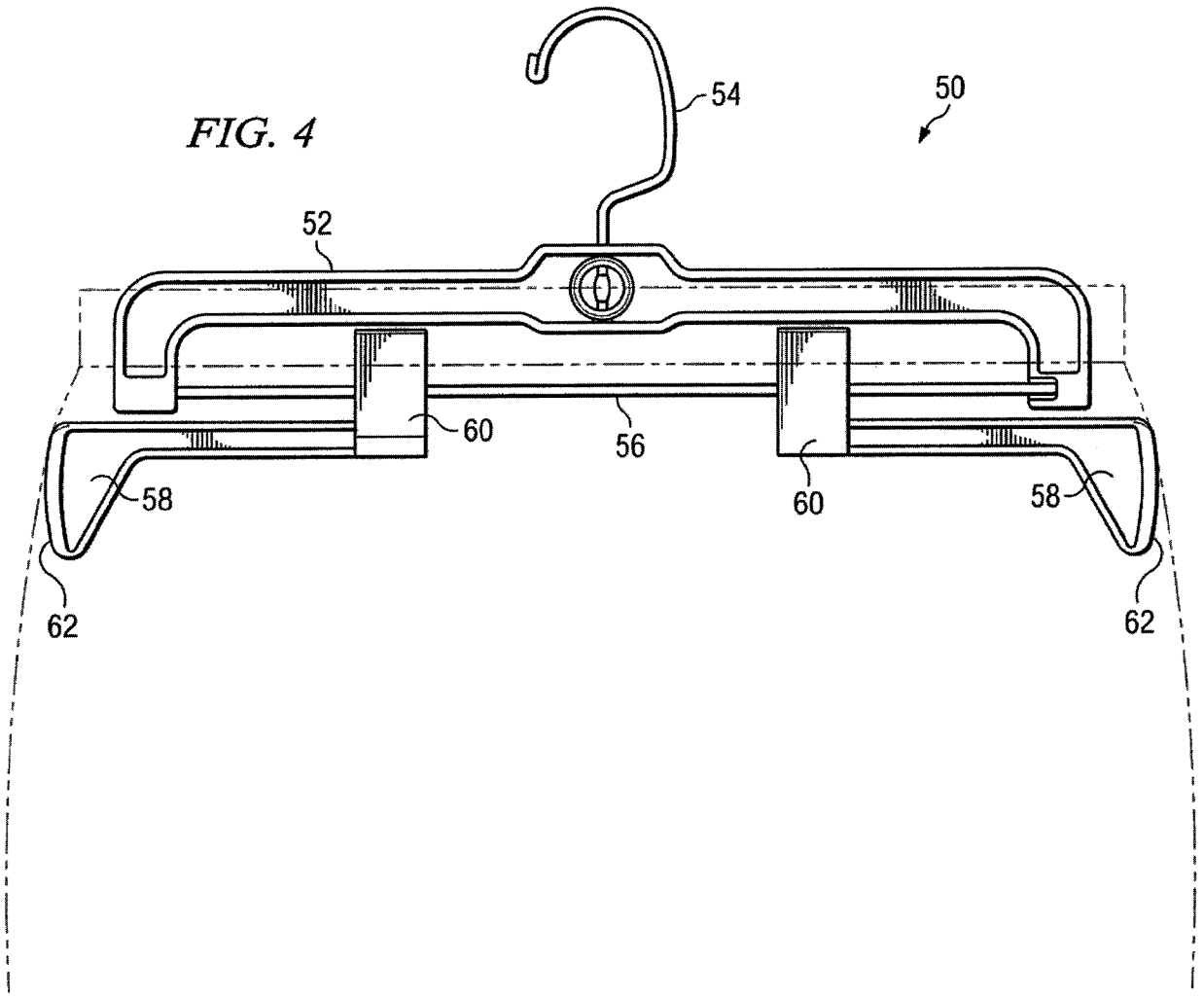
FIG. 4 is a front view of the clothes hanger of FIG. 3.
Figure 5:
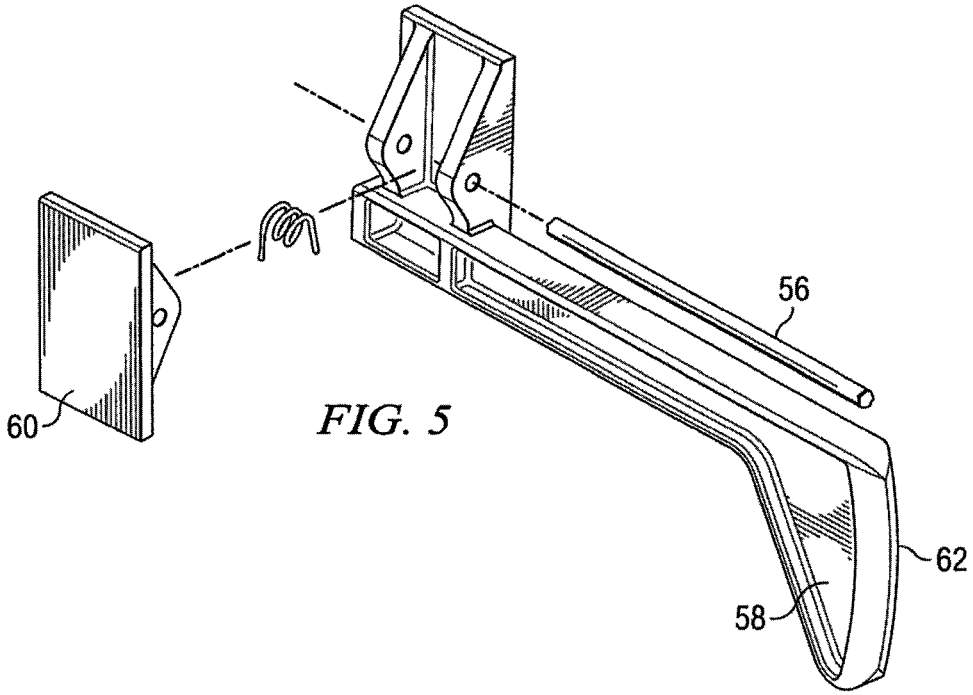
FIG. 5 is an exploded view of a portion of the clothes hanger of FIG. 3.

Referring to FIGS. 3, 4, and 5, there is shown clothes hanger 50 comprising a second embodiment of the present disclosure. Clothes hanger 50 comprises a plastic frame 52 having metal hook 54 extending upwardly therefrom. Metal support rod 56 extends between and is supported on the opposite ends of plastic frame 52. A pair of wings 58 is supported on support rod 56 for longitudinal movement therealong. Each wing 58 is provided with spring-loaded clip 60 that functions to secure the wing at a predetermined location along support rod 56 depending upon the requirements of particular applications of the present disclosure.

Because wings 58 are movable inwardly and outwardly on rod 56, hanger 50 is adapted for use with garments comprising a wide range of sizes, for example, from size 2 through and including size 20. The inward and outward movement of wings 58 allows hanger 50 to support garments thereon with no tension or stretching.

In the utilization of hanger 50, plastic wings 58 are moved outwardly until the end surfaces 62 thereof engage interior surfaces of a skit, a pair of shorts, or other garment. In use, wings 58 function to secure a garment on hanger 50 during transportation and storage of the garment. More importantly, wings 58 function to prevent damage to the garment during transportation and support thereof on hanger 50. The use of hanger 50 facilitates support and transportation of garments with no marking, no clip mark, or other damage as is sometimes experienced in the use of conventional clothes hangers.

Figure 6:
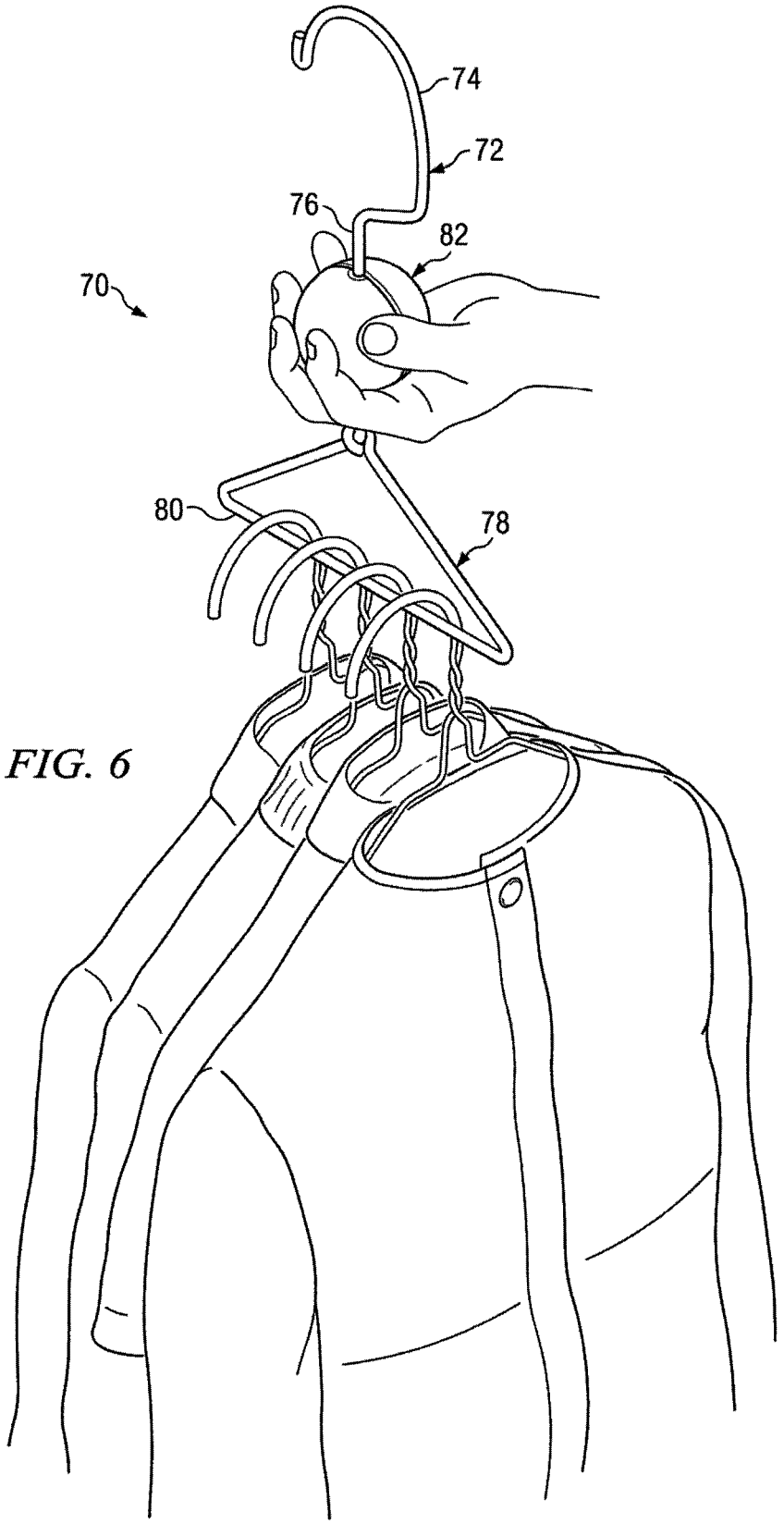
FIG. 6 is a perspective view of a garment transportation and storage device comprising a third embodiment of the present disclosure.

Referring to FIG. 6, there is shown garment transportation and storage device 70 comprising a third embodiment of the present disclosure. Device 70 comprises length of wire 72 that is formed into support hook 74 at the upper end thereof. The length of wire 72 extends downwardly from hook 74 through central portion 76. At the lower end of device 70, a length of wire 77 is bent into a triangular configuration 78 thus providing hanger support rod 80. Hook 74 is rotatably connected to support rod 80.

Ball-shaped handle 82 is secured around the central section 76 of the length of wire 72, it being understood that other handle configurations can be utilized in the practice of the present disclosure. Handle 82 may comprise a unitary construction formed from molded plastic or molded rubber. Alternatively, handle 82 may comprise a two-part construction that snaps together around the central portion 72 of the length of wire 72 as shown.

In use, garment transportation and storage device 70 is employed to receive garments from a laundry or dry cleaner. Garments supported on conventional hangers of the type utilized by laundries and dry cleaners are supported on support rod 80 by engaging the hooks of the hangers therewith in the conventional manner. After the hangers that support all of the garments received from a particular laundry or dry cleaner are engaged with support rod 80, handle 82 is utilized to transport device 70 and the garments supported thereby, for example, from the laundry or dry cleaners to a vehicle. At that point, hook 74 of device 70 is utilized to support device 70 and the garments supported thereby from the coat hanger of the vehicle. Another important use of device 70 is the transportation of garments supported on hangers from a laundry or dry cleaners to a residence in crowded urban areas such as New York City.

Upon arrival at a particular designation, device 70 is utilized to transport the garments supported by the support rod 80 to a storage location for example, a closet. Once again, the handle is utilized to facilitate lifting and carrying the garments supported on support rod 80. Hook 72 may be utilized to support the garments on a closet rod or the like while the garments are being individually disengaged from support rod 80. Thereafter, the garments are preferably disengaged from the hangers utilized by the laundry or the dry cleaners to deliver garments to customers and are transferred to hangers comprising the present invention, for example, the hangers shown in FIGS. 1-5, inclusive, hereof.

Figure 7:
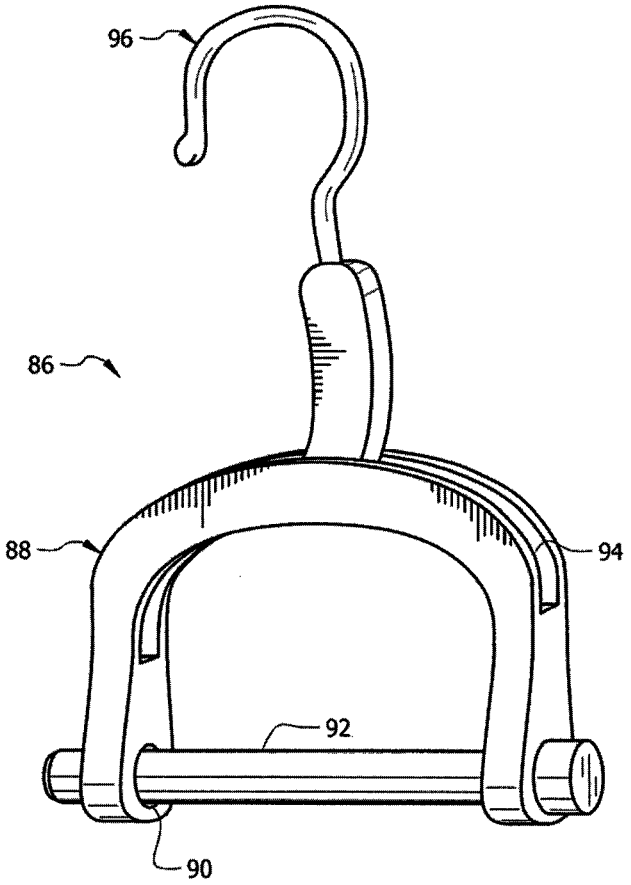
FIG. 7 is a perspective view of a garment transportation and storage device comprising an alternative version of the third embodiment.
Figure 8:
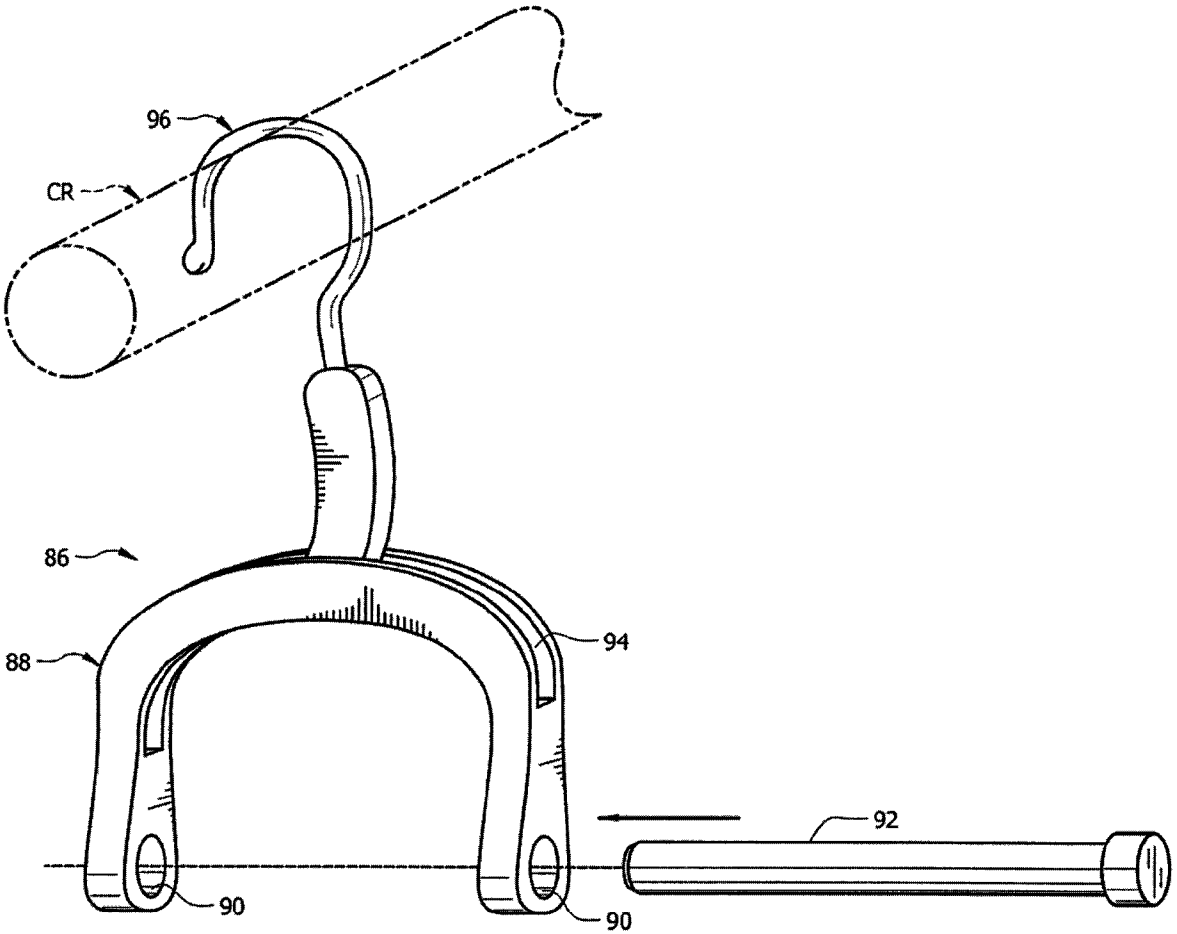
FIG. 8 is an exploded view further illustrating the garment transportation and storage device of FIG. 7.

Referring to FIGS. 7 through 16, inclusive, the present disclosure further comprises an alternative version of garment transportation and storage device 70 illustrated in FIG. 6 and described hereinabove in conjunction therewith. Referring to FIG. 7, article transportation and storage device 86 comprises an inverted U-shaped frame 88 comprising spaced apart downwardly extending legs and a handle extending between and connecting the legs. Aligned apertures 90 extend through the distal ends of the legs. Article support rod 92 is slidably received in apertures 90 for support by frame 88. As is shown in FIG. 8, rod 92 is adapted for disengagement from frame 88 to facilitate its engagement with or disengagement from articles transported by article transportation and storage device 86.

Figure 9:
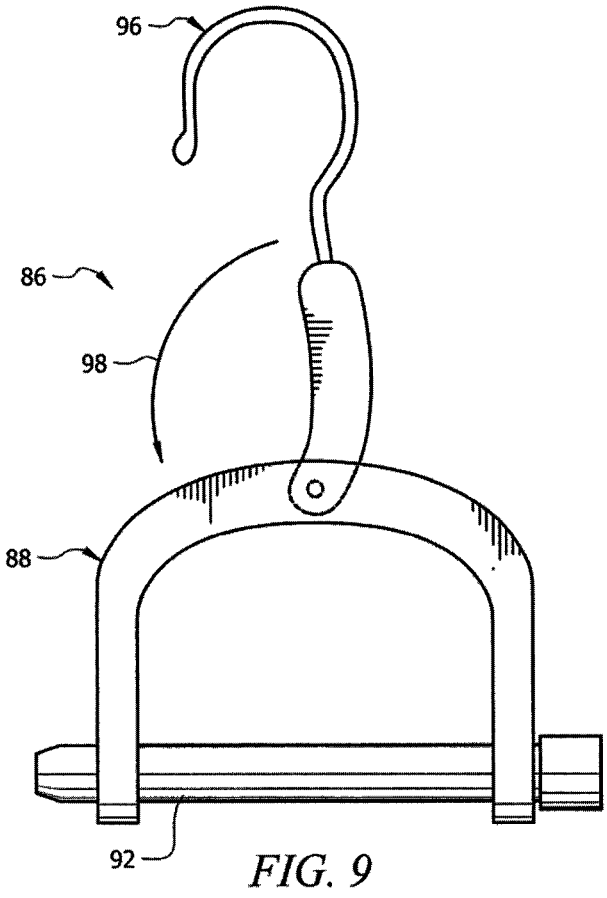
FIG. 9 is a front view illustrating a first orientation of the garment transportation and storage device of FIG. 7.
Figure 10:
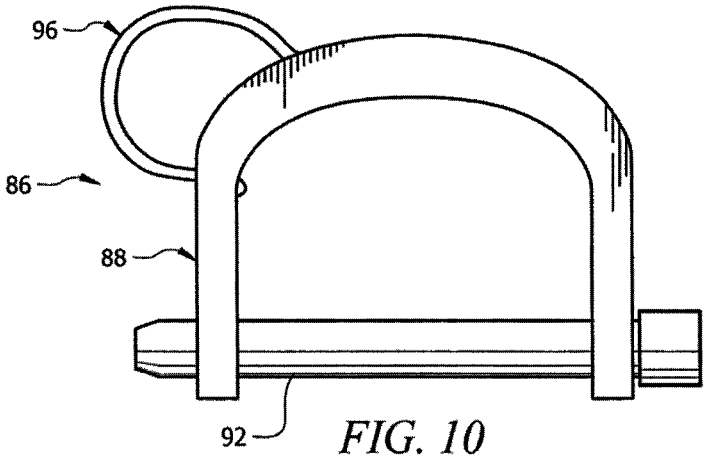
FIG. 10 is a front view similar to FIG. 8 illustrating a second orientation of the garment transportation and storage device of FIG. 7.
Figure 11:
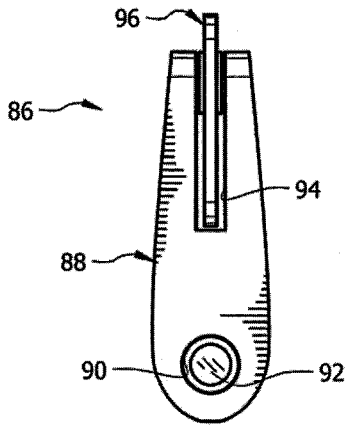
FIG. 11 is a left side view of the garment transportation and storage device of FIG. 7.
Figure 12:
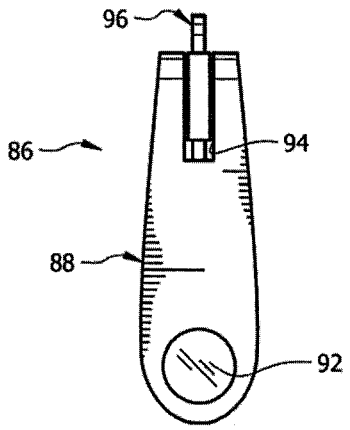
FIG. 12 is a right side view of the garment transportation and storage device of FIG. 7.

Referring to FIGS. 7 through 13, inclusive, frame 88 of article transportation and storage device 86 has slot 94 formed in the upper portion thereof. Hook 96 is pivotally supported on frame 88 and extends into slot 94. Referring particularly to FIG. 9, hook 96 is adapted for pivotal movement relative to frame 88 in the manner indicated by arrow 88. FIG. 10 shows hook 96 in its fully retracted orientation to facilitate use of the handle comprising V-shaped frame 88 in the transportation of articles. FIG. 8 illustrates the utilization of hook 96 to support article transportation and storage device 86 and articles supported thereby from a closet rod CR or similar structure.

Figure 13:
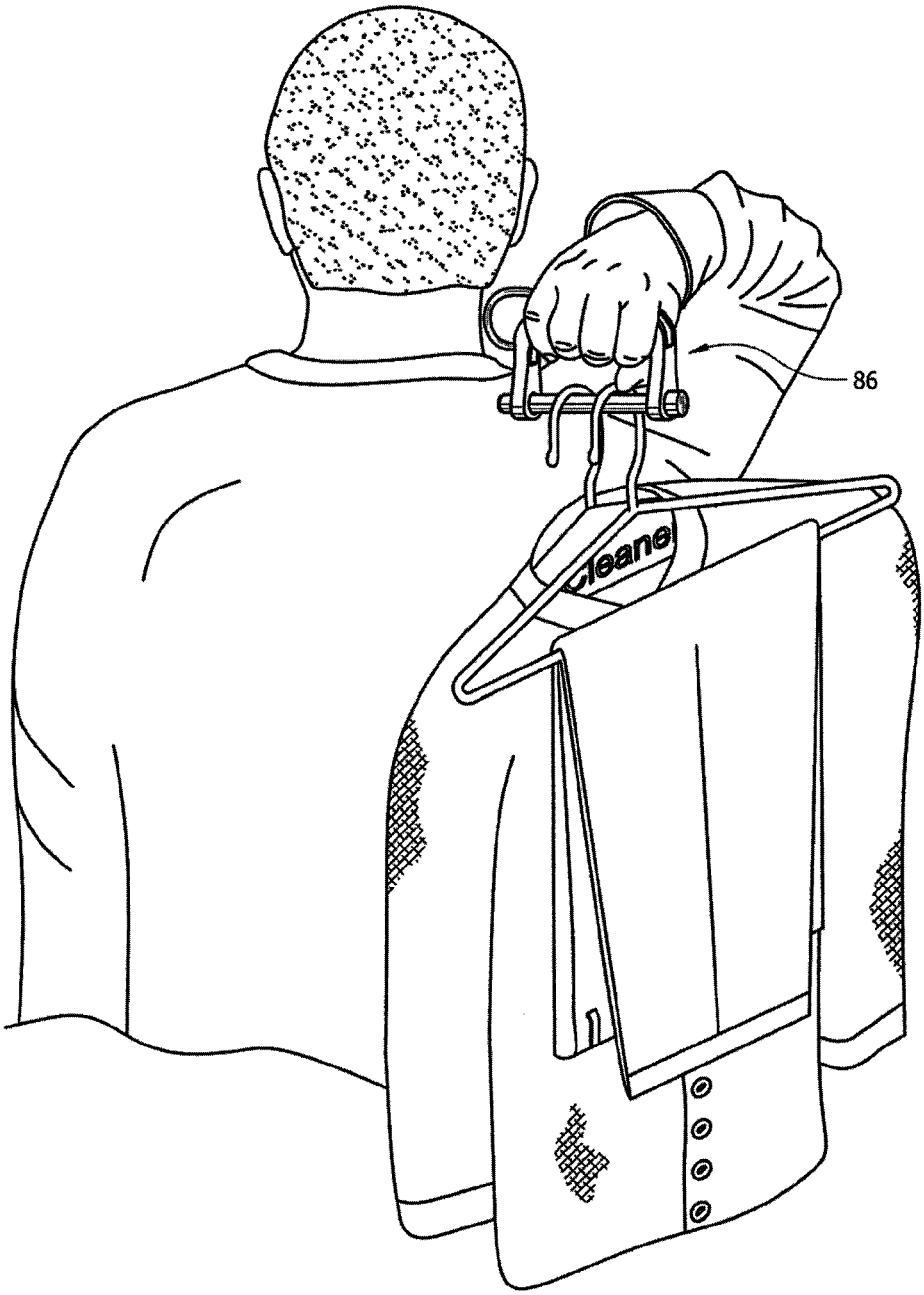
FIG. 13 is a diagrammatic view illustrating a first utilization of the garment transportation and storage device of FIG. 7.

FIG. 13 illustrates the use of article transportation and storage device 86 in the transportation of a plurality of hanger-borne clothes from a first location such as a retail store, a dry cleaner, a laundry, etc. to a second location such as a residence, an office, or other location selected by the owner and user of article transportation and storage device 86.

Figure 14:
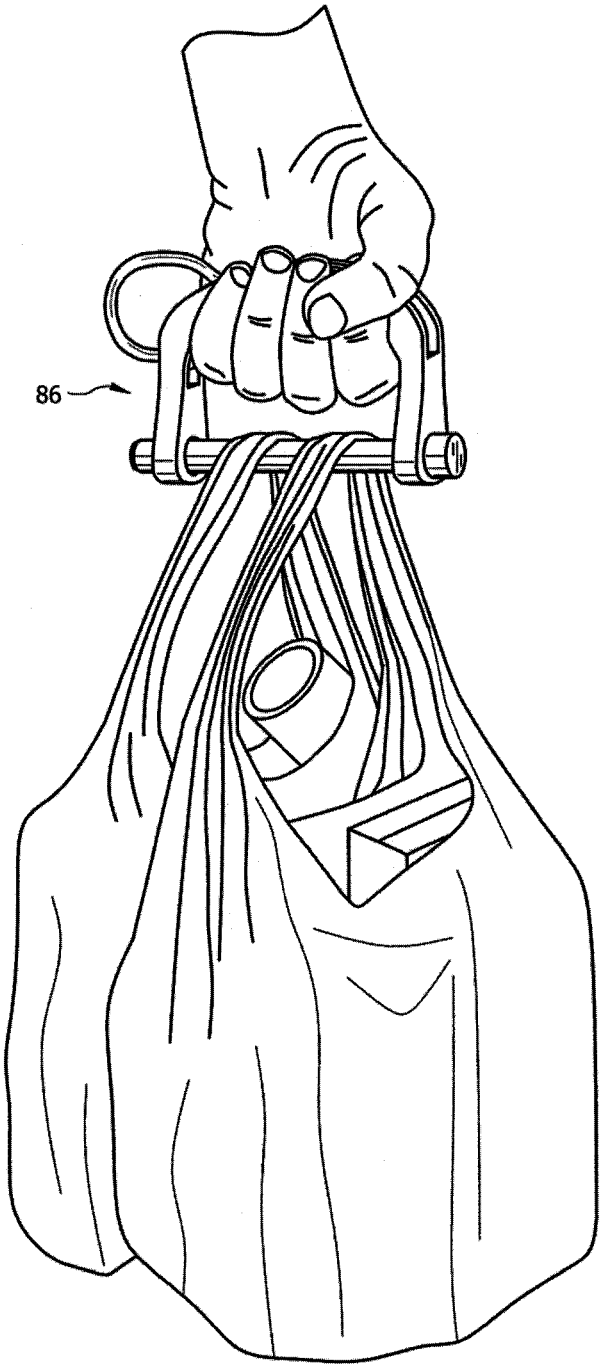
FIG. 14 is a diagrammatic view illustrating a second utilization of the garment transportation and storage device of FIG. 7.
Figure 15:
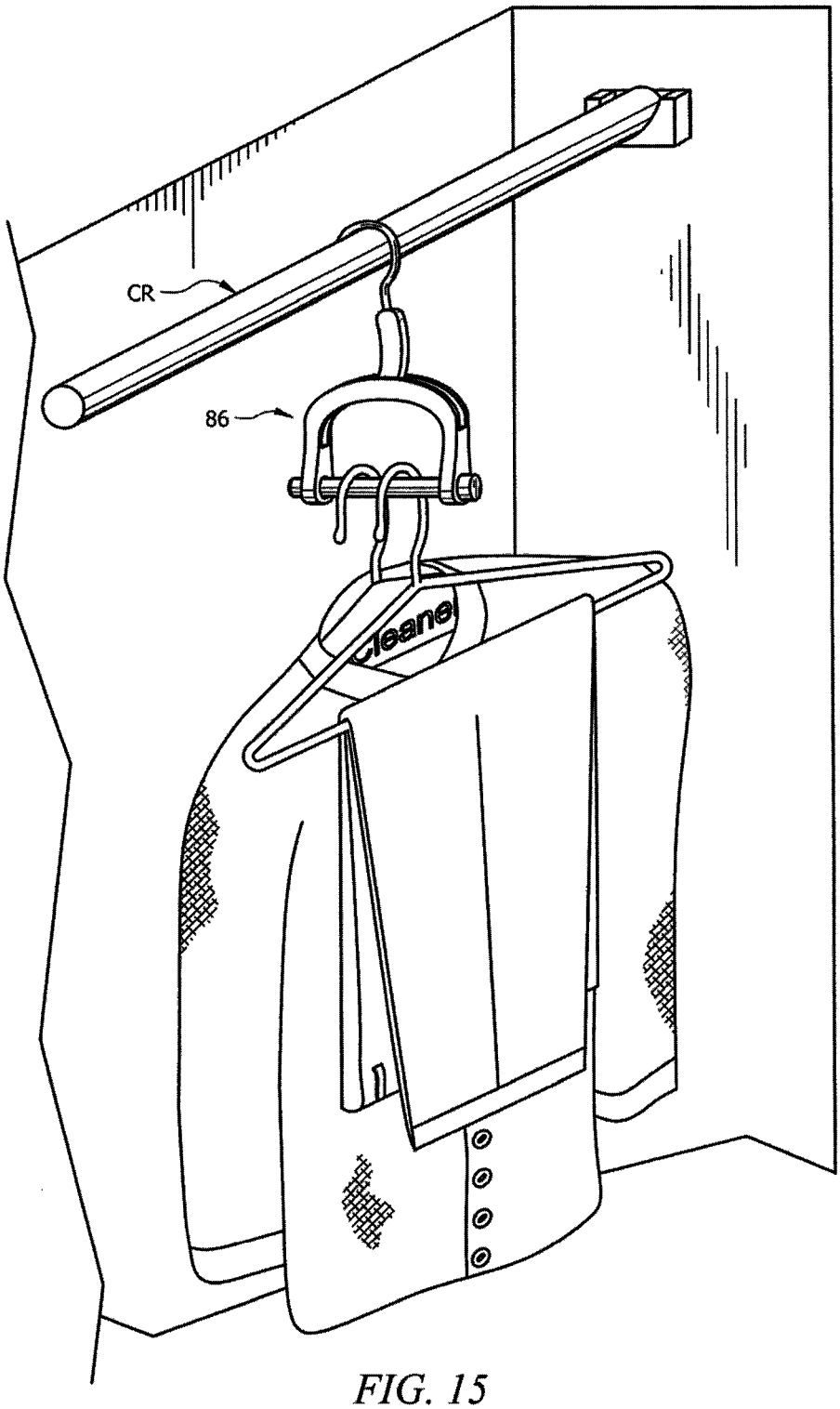
FIG. 15 is a diagrammatic view illustrating a third utilization of the garment transportation and storage device of FIG. 7.

FIG. 14 illustrates the use of article storage and transportation device 86 in the transportation of articles other than clothing. In particular, FIG. 14 illustrates the support and transportation of a pair of plastic bags that in turn support and transport a plurality of individual articles. The disengageability of support rod 92 from frame 88 of article transportation and storage device 86 is particularly advantageous when engaging device 86 with and disengaging device 86 from articles such as those illustrated in FIG. 14. FIG. 15 illustrates article transportation and storage device 86 utilized to support a plurality of hanger-borne articles from a closet rod CR or other structure.

Figure 17:
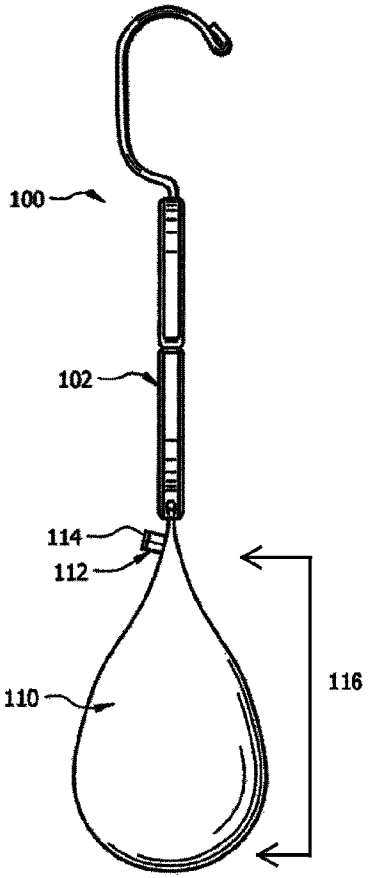
FIG. 17 is a side view of the clothes hanger of FIG. 16.
Figure 16:
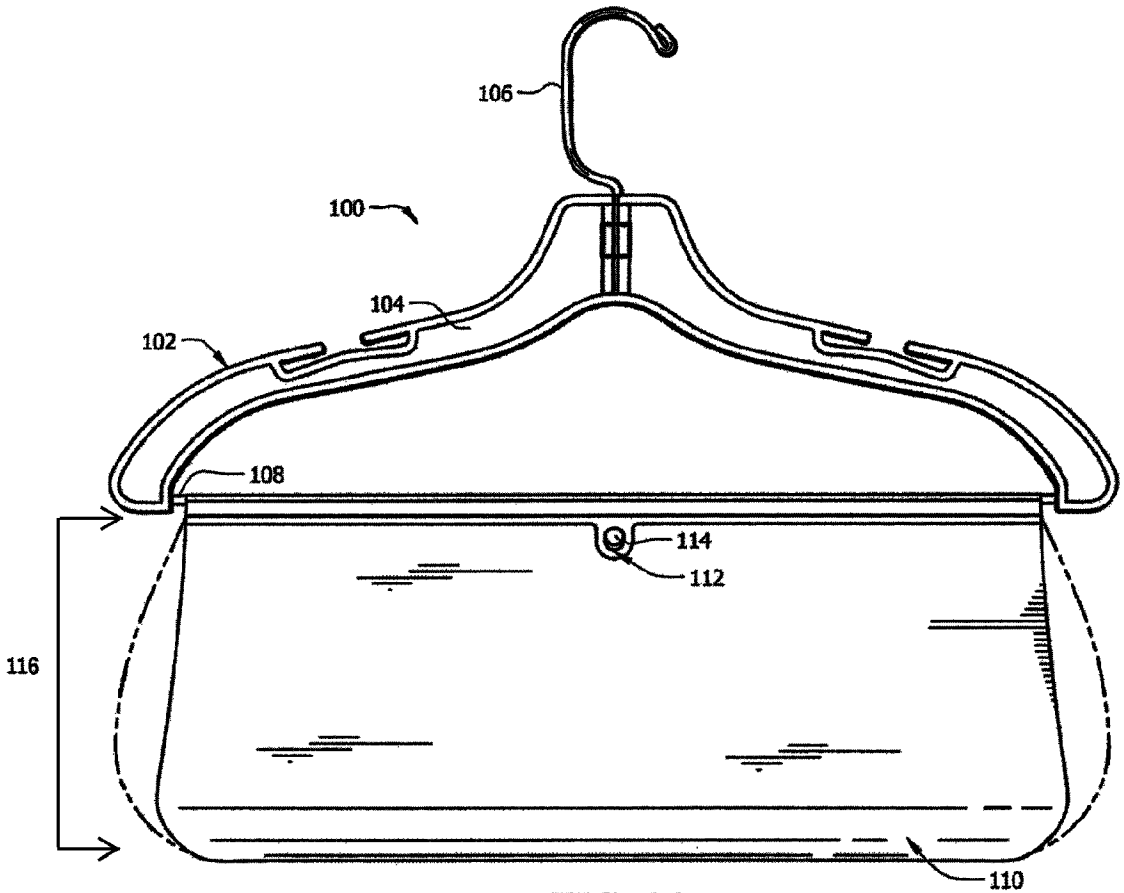
FIG. 16 is a front view of a clothes hanger comprising a fourth embodiment of the present disclosure.
Figure 19:
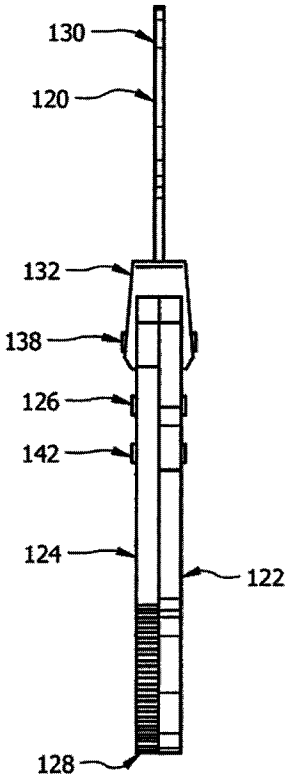
FIG. 19 is a side view of the garment transportation and storage device of FIG. 18.
Figure 18:
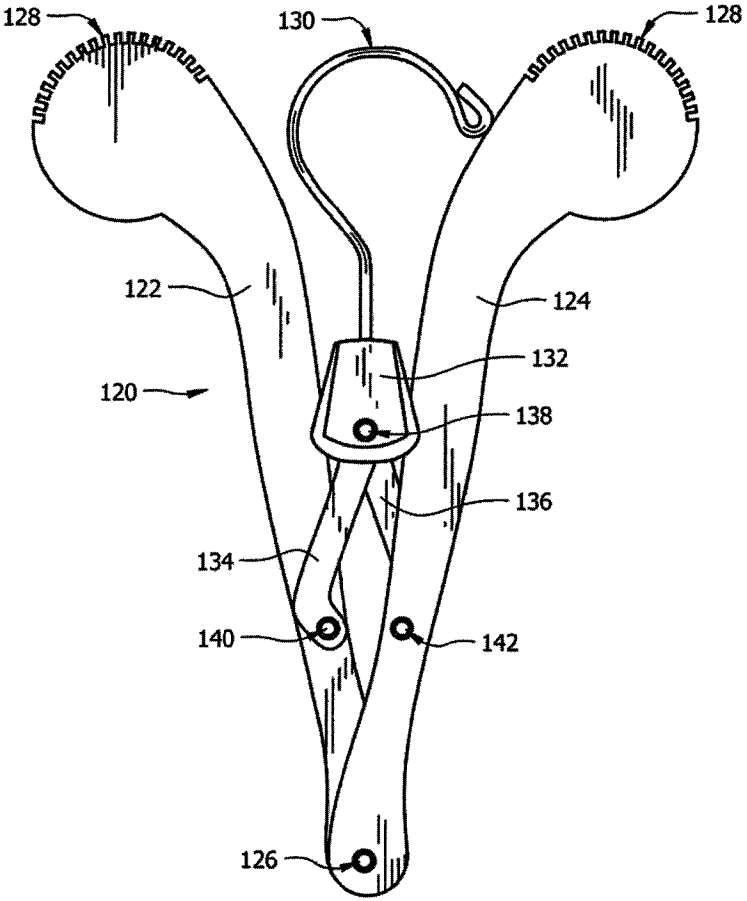
FIG. 18 is a front view of a garment transportation and storage device comprising a fifth embodiment of the present disclosure in which the garment transportation and storage device is shown in its folded configuration.

FIGS. 16 and 17 illustrate clothes hanger 100 comprising a fourth embodiment of the present disclosure. The upper portion of clothes hanger 100 comprises conventional plastic clothes hanger 102 that includes plastic frame 104, metal hook 106 adapted to support clothes hanger 100 on a closet rod and metal clothing support rod 108 extending between the opposed legs comprising plastic frame 104.

Inflatable garment protecting device 110 is supported on rod 108 and is provided with inflation/deflation port 112 including stopper 114 adapted to retain garment protection device 110 in its inflated configuration.

As is well known, garments supported from a hanger, such as hanger 102 illustrated in FIGS. 16 and 17, for an extended period of time become wrinkled and misshapen. In accordance with the present disclosure, garment protection 110 is inflated by disengaging stopper 114 and blowing through port 112 until garment protection device 110 includes inflated portion 116, which assumes the inflated configuration illustrated in FIGS. 16 and 17. Thereafter stopper 114 is re-engaged with port 112 to prevent deflation of garment protection device 110.

When inflated, garment protection device 110 functions to expand garments supported by hanger 102. In this manner, the garments are retained in an expanded condition, which eliminates the problem of garments becoming wrinkled and misshapen when they are hung from a conventional hanger.

FIGS. 18 through 21, inclusive, illustrate clothes hanger 120 comprising a fifth embodiment of the present disclosure. Clothes hanger 120 comprises a pair of opposed arms 122 and 124 having proximal ends that are pivotally connected to one another at 126. The distal ends of arms 122 and 124 are provided with garment engaging teeth 128. Metal support hook 130 extends to connecting block 132. A pair of control arms 134 and 136 is pivotally connected to block 132 at 138 and is pivotally connected to arms 122 and 124, respectively, at 140 and 142, respectively.

Figure 20:
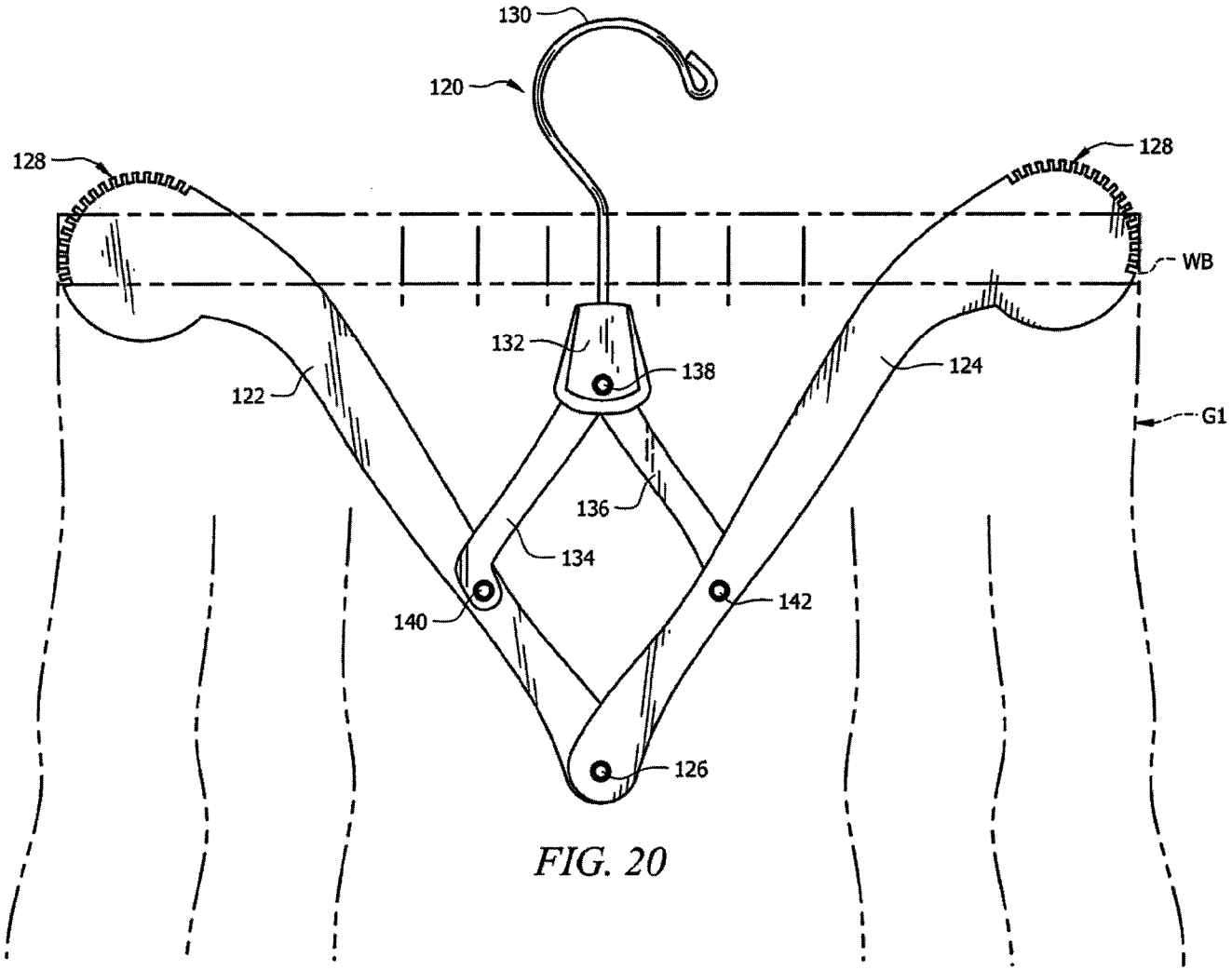
FIG. 20 is a diagrammatic view illustrating a first utilization of the garment transportation and storage device of FIG. 18.

FIG. 20 illustrates garment transportation device 120 utilized to support and transport a garment G1 that may comprise a skirt or pair of slacks. Teeth 128 of garment transportation device 120 engage the interior surfaces comprising the waistband WB of the garment G1. As will be appreciated by those skilled in the art, the weight of the garment G1 tends to pull arms 122 and 124 downwardly. However, because arms 122 and 124 are connected to garment support member 130 by block 132 and arms 134 and 136, any downward movement of arms 122 and 124 causes outward movement of the distal ends thereof, thereby forcing teeth 128 into firm gripping engagement with the interior surface of the waistband WB of the garment G1. In this manner, the garment G1 is firmly secured on garment transportation device 120 during both transportation and storage thereof.

Figure 21:
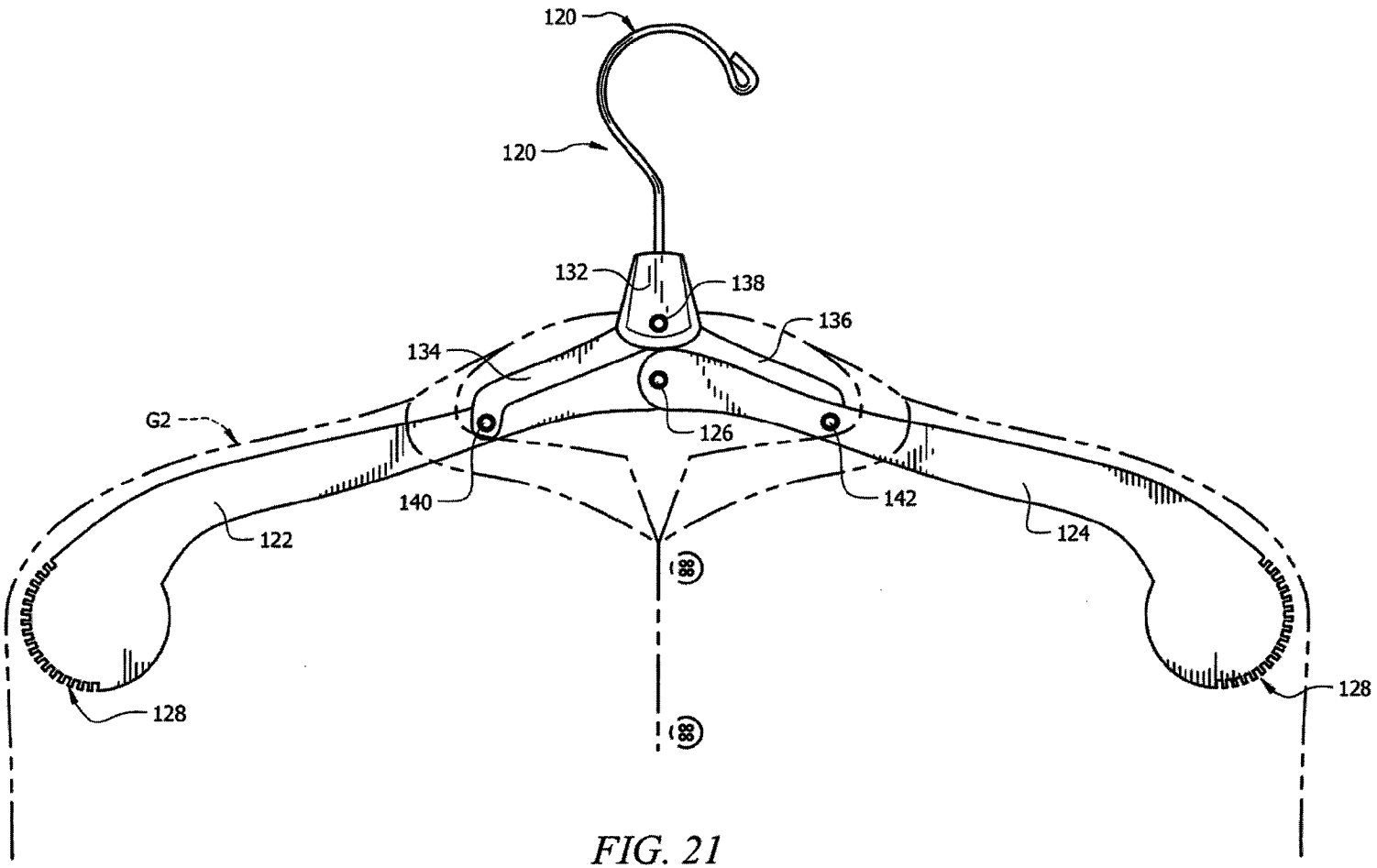
FIG. 21 is a diagrammatic view illustrating a second utilization of the garment transportation and storage device of FIG. 18.

FIG. 21 illustrates garment transportation device 120 utilized to transport and support a garment G2 comprising a jacket or a dress. Once again, the weight of the G2 tends to pull arms 122 and 124 downwardly. However, because arms 122 and 124 are secured to garment support member 130 by block 132 and arms 134 and 136, any downward movement of arms 122 and 124 caused by the weight of garment G2 causes arms 122 and 124 to pivot outwardly, thereby securely retaining the garment G2 on garment transportation device 120.

Although preferred embodiments of the present disclosure have been illustrated in the accompanying Drawings and described in the foregoing Detailed Description, it will be understood that the present disclosure is not limited to the embodiments disclosed, but is capable of numerous rearrangements, modifications, and substitutions of parts and elements without departing from the spirit of the present disclosure.

The invention claimed is:

1. A clothes hanger having a triangular frame having downward-sloping opposed legs, a vertically extending hook adapted to support the clothes hanger on a closet rod and a clothing support rod extending horizontally between the downward-sloping opposed legs of the frame, the clothes hanger comprising:

an inflatable garment protecting device provided to retain at least one garment in an inflated configuration, a single inflated portion of the inflatable garment protecting device located only below the clothing support rod and across a length of the clothing support rod between the opposed legs, wherein the clothes hanger includes the single inflated portion and no additional inflatable portions, wherein a length of the single inflated portion is parallel with the length of the clothing support rod and is the longest dimension of the clothes hanger, and wherein the inflatable garment protecting device is supported by the clothing support rod and extends downward in a vertical direction from the clothing support rod across the length of the clothing support rod, the inflatable garment protecting device comprising:

an inflation port with a stopper, the inflation port and the stopper provided below the clothing support rod and adapted to retain the inflatable garment protecting device in the inflated configuration wherein the inflatable garment protecting device expands within the garment hung from the clothes hanger when in the inflated configuration, thereby expanding the garment hanging downward in a vertical direction from the clothing support rod to prevent wrinkling of the garment.

* * * * *